US007651085B2

(12) United States Patent
Terao et al.

(10) Patent No.: US 7,651,085 B2
(45) Date of Patent: Jan. 26, 2010

(54) MEDIUM EDGE GUIDE WITH ANGLED FACES IN MEDIUM FEEDER AND RECORDING APPARATUS OR LIQUID EJECTING APPARATUS INCORPORATING THE SAME

(75) Inventors: Takuya Terao, Nagano-ken (JP); Yosuke Nakano, Nagano-ken (JP); Tsuyoshi Sekizawa, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 481 days.

(21) Appl. No.: 11/392,766

(22) Filed: Mar. 30, 2006

(65) Prior Publication Data

US 2006/0237897 A1 Oct. 26, 2006

(30) Foreign Application Priority Data

Mar. 31, 2005 (JP) ..... 2005-103997
Jul. 29, 2005 (JP) ..... 2005-221178

(51) Int. Cl.
*B65H 1/00* (2006.01)

(52) U.S. Cl. ..... 271/145

(58) Field of Classification Search ..... 271/145
See application file for complete search history.

(56) References Cited

U.S. PATENT DOCUMENTS 5,685,533 A * 11/1997 Hartsoe ..... 271/11
6,793,215 B2 * 9/2004 Salomon ..... 271/171
2002/0056961 A1 * 5/2002 Sasaki et al. ..... 271/145

FOREIGN PATENT DOCUMENTS

| | | | |
|---|---|---|---|
| EP | 0 590 822 | A1 | 4/1994 |
| JP | 58148137 | | 9/1983 |
| JP | 09110181 | | 4/1997 |
| JP | 2001-278500 | A | 10/2001 |
| JP | 2002-205828 | A | 7/2002 |
| JP | 3092370 | U | 12/2002 |

* cited by examiner

*Primary Examiner*—Patrick H Mackey
*Assistant Examiner*—Gerald W McClain
(74) *Attorney, Agent, or Firm*—Sughrue Mion, PLLC

(57) ABSTRACT

A feeder is adapted to feed a medium to an apparatus body in a first direction. The feeder is provided with a first face adapted to support the medium from below. A first edge guide is disposed on the first face and having a first guiding face adapted to support a first side edge of the medium. A second edge guide is disposed on the first face and having a second guiding face adapted to support a second side edge of the medium. The first guiding face includes: a second face extending such that a first angle is formed by the first face and the second face; and a third face located in a downstream side of the second face relative to the first direction, and extending such that a second angle which is different from the first angle is formed by the first face and the third face. One of the first angle and the second angle is 90 degrees and the other one is greater than 90 degrees.

1 Claim, 13 Drawing Sheets

MEDIUM EDGE GUIDE WITH ANGLED FACES IN MEDIUM FEEDER AND RECORDING APPARATUS OR LIQUID EJECTING APPARATUS INCORPORATING THE SAME

BACKGROUND Of THE INVENTION

The present invention relates to a medium edge guide in a medium feeder provided with a tray. The medium edge guide is adapted to be abutted on a side edge of a target medium, thereby aligning target media stacked on the tray and preventing a skew feeding of the target medium. The present invention also relates to a recording apparatus or a liquid ejecting apparatus incorporating the same.

The liquid ejecting apparatus is not restricted to recording apparatuses such as a printer, a copying machine and a facsimile in which a recording head of an ink jet type is used and an ink is ejected from the recording head to carry out recording over a recording medium but includes an apparatus for ejecting a liquid corresponding to uses from a liquid ejecting head corresponding to the recording head onto a liquid injected material corresponding to the target medium in place of the ink and sticking the liquid to the liquid injected material.

Examples of the liquid ejecting head include a coloring agent ejecting head to be used for manufacturing a color filter of a liquid crystal display, an electrode material (conducting paste) ejecting head to be used for forming an electrode of an organic EL display or a surface emitting display (FED), a bio-organic substance ejecting head to be used for manufacturing a biochip and a sample ejecting head to be a precision pipette in addition to the recording head.

The recording apparatus is not limited to a printer, a copier, or a facsimile which employs an ink jet recording head and ejects ink from the recording head to a recording medium, to thus effect recording. The recording apparatus is employed to encompasses an apparatus that performs recording on a recording medium in a dot-impact manner or a thermal transfer manner.

Description will be given by taking, as an example, an ink jet printer to be an example of a recording apparatus or a liquid ejecting apparatus.

The ink jet printer comprises, as a part of the ink jet printer or an accessory of the ink jet printer, a feeding tray fixed to a printer body, an automatic sheet feeder for feeding cut sheets, a feeding cassette for feeding cut sheets which is provided removably with respect to the printer body or a rolled sheet holder for attaching a rolled sheet.

There are provided a pair of edge guides adapted to be abutted on both side edges of sheets stacked on the feeding tray or a sheet supplied from the rolled sheet holder, thereby preventing the skew feeding of the sheet. Such an edge guide is provided with a guiding face abutting directly on the side edge of the sheet, and the guiding face is generally constituted by a vertical regulating face which is perpendicularly extended from a sheet mounting face.

When the guiding faces are entirely constituted by the vertical regulating faces, the regulation of the sheet becomes excessively strict, which is preferable for preventing a shift in the position of the sheet or the alignment of the sheets. On the other hand, in some cases in which a width of the sheet has a variation or a side edge of the sheet happens to be not straight, a frictional resistance acts on the side edge of the sheet from the guiding face so that the smooth feeding of the sheet cannot be carried out.

Japanese Patent Publication No. 2001-278500A discloses an edge guide in which a plurality of ribs are arranged on the guiding face of the edge guide and elongated in a certain direction relative to the sheet feeding direction, so that a frictional resistance can be decreased to smoothly feed the sheet. Also in the case in which such an edge guide is applied, however, the corner portion of the sheet is caught on the rib to bend the sheet or a skew is generated on the sheet to cause a printing defect during the feeding of the sheet. For this reason, there has been desired the improvement or development of the edge guide capable of smoothly feeding the sheet without depending on the quality or properties of the sheet.

Moreover, Japanese Patent Publication No. 2002-205828A discloses a movable guide having an upstream guiding face extending in a sheet feeding direction and a downstream guiding face continued from the upstream guiding face and inclining outward from the sheet feeding direction. In addition, the upstream guiding face is inclined outward from the normal direction of a sheet mounting face. Due to this inclination, in a case where many sheets are stacked on the sheet mounting face, upper ones of the stacked sheets would not be regulated strictly.

SUMMARY OF THE INVENTION

It is therefore an object of the invention to provide a medium edge guide in a feeder capable of smoothly feeding a target medium without skew irrespective of a difference in quality and properties of the target medium.

It is also an object of the invention to provide a recording apparatus or a liquid ejecting apparatus incorporating such a medium edge guide.

In order to achieve the above object, according to the invention, there is provided a feeder, adapted to feed a medium to an apparatus body in a first direction, the feeder comprising:

- a first face, adapted to support the medium from below;
- a first edge guide, disposed on the first face and having a first guiding face adapted to support a first side edge of the medium;
- a second edge guide, disposed on the first face and having a second guiding face adapted to support a second side edge of the medium, wherein:
- the first guiding face includes;
  - a second face extending such that a first angle is formed by the first face and the second face; and
  - a third face located in a downstream side of the second face relative to the first direction, and extending such that a second angle which is different from the first angle is formed by the first face and the third face; and
- one of the first angle and the second angle is 90 degrees and the other one is greater than 90 degrees.

With this configuration, a frictional resistance from the first guiding face acting on the first side edge of the medium can be reduced and the smooth feeding of the medium can be executed without the influence of a difference in the quality and properties of the medium. Moreover, the medium which is lifted by the hopper and the medium which is returned by the returning lever can be guided to slide over the third face and can be aligned and returned to an original position.

The first angle may be 90 degrees and the second angle may be greater than 90 degrees.

In this case, in the initial stage of the feeding operation in which the trailing end portion of the side edge of the medium is held by the second face, the strict regulation of the side edge of the medium is maintained and the skew of the medium is prevented from being generated. Moreover, the second face is simply provided in the range of a part of the first guiding face.

Therefore, the frictional resistance acting on the side edge of the medium is reduced and the smooth feeding of the medium is also secured. In the final stage of the feeding operation in which the trailing end portion of the side edge of the medium passes through the second face, moreover, the regulation for the side edge of the medium is slightly relieved. Consequently, the medium can be fed still more smoothly.

The first angle may be greater than 90 degrees and the second angle may be 90 degrees.

In this case, the strict regulation of the side edge of the medium is maintained from the initial stage of the feeding operation to the final stage in which the trailing end portion of the side edge of the medium separates from the edge guides. Therefore, the generation of the skew of the medium can be prevented through the whole range of the feeding operation. Moreover, the second face is simply provided in the range of a part of the first guiding face. Therefore, the frictional resistance acting on the side edge of the medium is reduced and the smooth feeding of the medium is also secured. Moreover, the trailing end portion of the side edge of the medium lifted by the hopper or the medium returned by the returning lever can be guided by the inclined regulating face and can be thus returned to the original position without catching on the edge guide by the presence of the third face provided on the upstream side in the sheet feeding direction (first direction) of the medium.

The first edge guide may be movable in a second direction perpendicular to the first direction. The second edge guide may be fixed on the first face. An angle formed by the first face and the second guiding face may be 90 degrees.

With this configuration, the strict regulation of the side edge of the medium is maintained by the second guiding face of the fixed second edge guide from the initial stage of the feeding operation to the final stage of the feeding operation in which the trailing end portion of the side edge of the medium separates from the edge guides. Consequently, the skew of the medium is reliably prevented from being generated through the whole range of the feeding operation.

The second edge guide may include: a fourth face extending such that a third angle is formed by the first face and the fourth face; and a fifth face located in a downstream side of the fourth face relative to the first direction, and extending such that a fourth angle which is different from the third angle is formed by the first face and the fifth face. One of the third angle and the fourth angle may be 90 degrees and the other one may be greater than 90 degrees.

With this configuration, the frictional resistances from the first and second guiding faces acting on both side edges of the medium can be reduced together so that the medium can be fed still more smoothly.

The first angle and the third angle may be 90 degrees, and the second angle and the fourth angle may be greater than 90 degrees. Alternatively, the first angle and the third angle may be greater than 90 degrees, and the second angle and the fourth angle may be 90 degrees.

With the above configurations, the medium which is lifted by the hopper or the medium which is returned by the returning lever can be symmetrically guided to the inclined regulating face and can be aligned, and can be thus returned to the original position. Furthermore, the vertical regulating face is provided in a part of the first and second guiding faces in the two opposed edge guides. Therefore, some strict regulation with respect to the side edges of the medium is also maintained. In addition, since the vertical regulating face and the inclined regulating face are arranged symmetrically, the frictional resistance acting on the side edges of the medium is balanced. Thus, it is also possible to prevent the skew of the medium during the feeding operation.

The first angle and the fourth angle may be 90 degrees, and the second angle and the third angle may be greater than 90 degrees. Alternatively, the first angle and the fourth angle may be greater than 90 degrees, and the second angle and the third angle may be 90 degrees.

With the above configurations, the vertical regulating face and the inclined regulating face exhibit their advantageous function while complementing mutual disadvantages.

Lower ends of the second face and the third face may be flush with each other.

With this configuration, it is possible to execute some strict regulation of the side edge of the medium, the function of aligning the medium which is brought by the regulation and the function of preventing the skew of the medium during the feeding operation.

The first guiding face may include a fourth face located in the downstream side of the second face relative to the first direction, and extending parallel to the second face. The fourth face may be retracted outward from the second face. A lower end of the third face and an upper end of the fourth face may be continuous.

With this configuration, since the second face is placed in such a position that the side edge on the trailing end portion of the medium can be guided. In the initial stage of the feeding operation of the medium, therefore, the strict regulation of the side edge of the medium is maintained by the second face so that the generation of the skew of the medium is prevented. Even if the skew tendency remains in the medium at the final stage of the feeding operation, since the fourth face is away from the side edge of the medium is placed in the opposed position to the side edge of the trailing end portion of the medium, it is possible to prevent the side edge of the trailing end portion of the medium from strongly coming in contact with the third face. In other words, it is possible to reduce a frictional resistance (a back tension) between the side edge of the medium and the edge guide, thereby carrying out a smooth feeding operation.

According to the invention, there is also provided a recording apparatus, comprising: the above feeder; and a recording head, disposed in the apparatus body, and operable to record information on the medium fed by the feeder.

In this case, it is possible to execute the recording operation with high precision over the medium.

According to the invention, there is also provided a liquid ejecting apparatus, comprising: the above feeder; and a liquid ejecting head, disposed in the apparatus body, and operable to eject liquid toward the medium fed by the feeder.

In this case, it is possible to execute the liquid ejecting operation with high precision over the medium.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE EMBODIMENTS

Embodiments of the invention will be described below in detail with reference to the accompanying drawings.

As a first embodiment, there will be described an ink jet printer 100 which is an example of a liquid ejecting apparatus and a recording apparatus of the invention.

Figure 1:
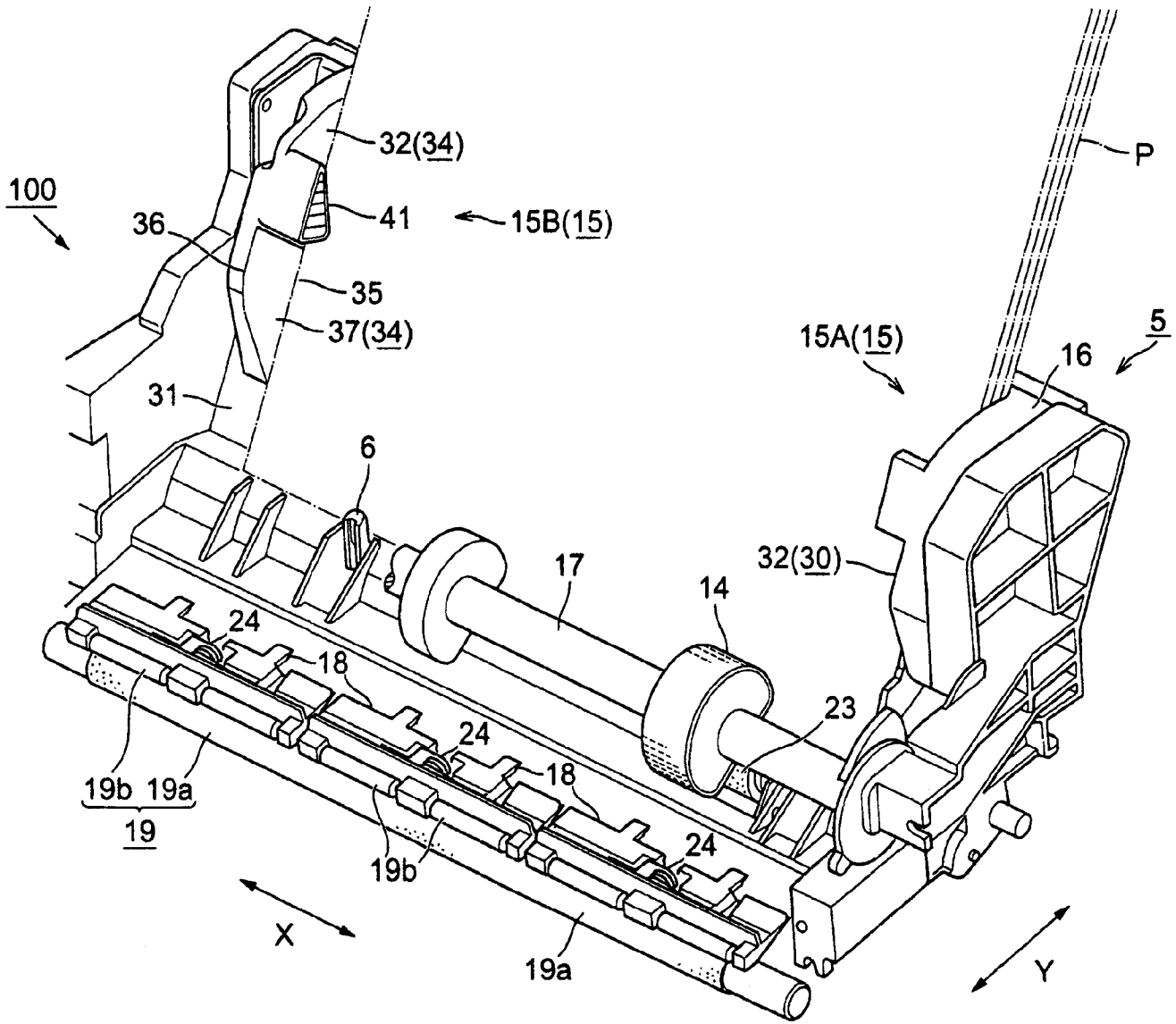
FIG. 1 is a perspective view showing a part of an internal structure of an ink jet printer according to a first embodiment of the invention.
Figure 2:
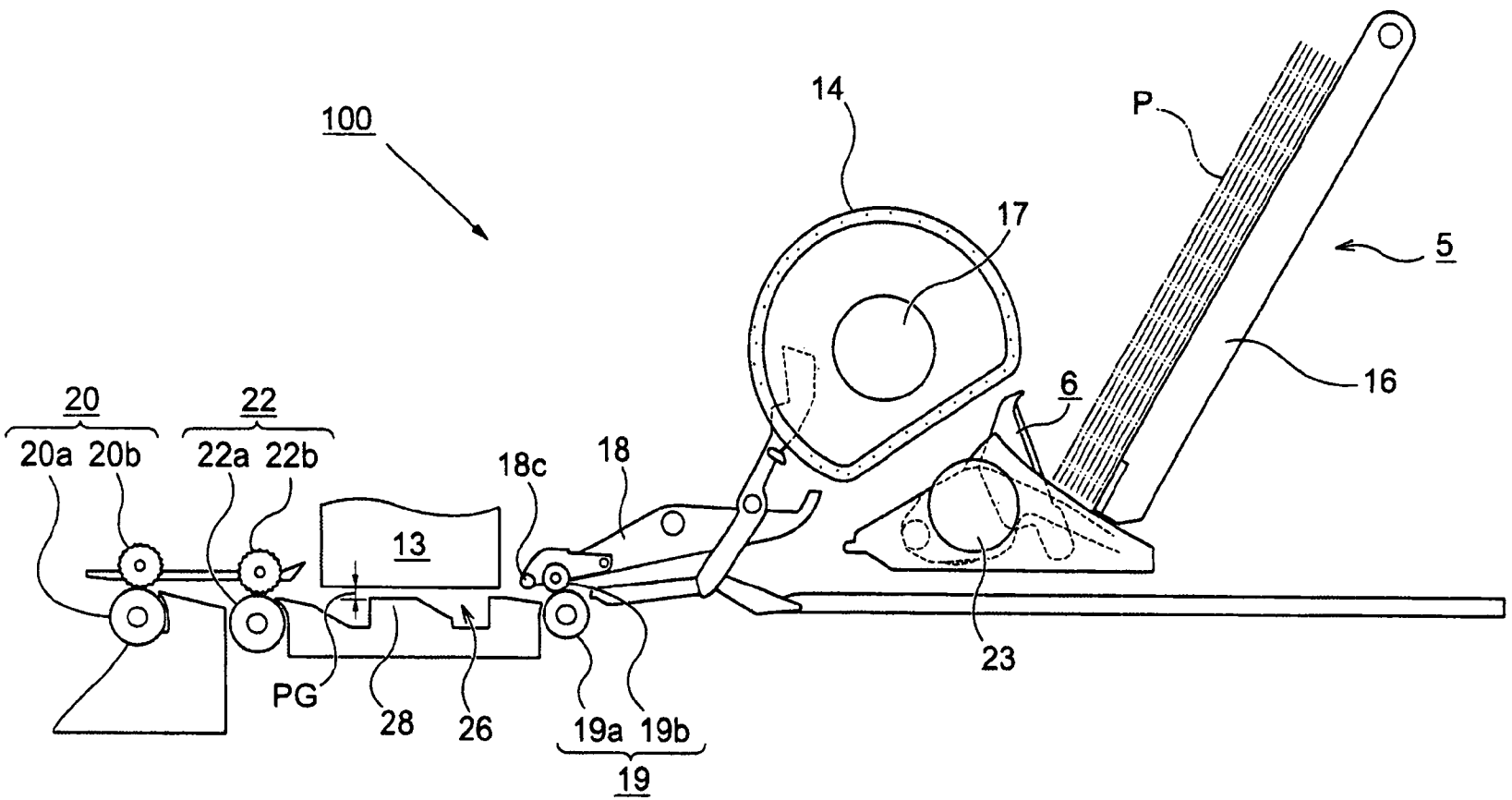
FIG. 2 is a sectional side view schematically showing the whole internal structure of the ink jet printer.

As shown in FIGS. 1 and 2, the ink jet printer 100 comprises a feeding tray 5 located at an upstream part of a transporting path of a sheet P and adapted to support a plurality of sheets P stacked thereon. The feeding tray 5 is a pair of edge guides 15 adapted to abut on both side edges of the sheet P to place the sheet P at a correct position relative to the width direction thereof.

A hopper 16 is lifted at a predetermined timing with a rotation of a rotary shaft 17 of the sheet feeding roller 14 so that the sheet P stacked on the feeding tray 5 is pushed up toward the sheet feeding roller 14. The upper ones of the stacked sheets P which are pushed up toward the sheet feeding roller 14 are pulled out by nipping action of the sheet feeding roller 14 and the hopper 16 so that the uppermost sheet P and the succeeding sheets P are separated from each other by the force of a retard roller 23. Moreover, the uppermost sheet P is transferred toward a downstream in the sheet feeding direction (leftward in FIG. 2) and the succeeding sheets P are pushed up toward an upstream in the sheet feeding direction (rightward in FIG. 2) by a returning lever 6 and are returned to an original position on the feeding tray 5 again, and are thus brought into a stacked state.

On a downstream of the sheet feeding roller 14, there is provided a detecting lever (not shown) for detecting a passage of the sheet P. A sheet transporting roller 19 constituted by a driving roller 19*a* and a follower roller 19*b* is provided on a downstream of the detecting lever. The follower roller 19*b* is supported on a downstream side of a roller holder 18 which is pivotable about a pivot shaft and is urged by a torsion coil spring 24 so that the follower roller 19*b* is always coming in pressure contact with the driving roller 19*a*.

Moreover, an auxiliary pressing roller 18*c* is provided in the downstream side of the roller holder 18 in the sheet feeding direction and is supported on a roller holder which is pivotable about a shaft of the follower roller 19*b*. The auxiliary pressing roller 18*c* is provided in order to prevent a wear in a head face of a recording head 13 from being caused by a rise in a leading end of the sheet P. The sheet P nipped between the driving roller 19*a* and the follower roller 19*b* is transported to a recording section 26 while passing below the auxiliary pressing roller 18*c*.

In the recording section 26, there is provided a carriage (not shown) supported pivotally by a carriage guide shaft and capable of moving reciprocally in a primary scanning direction X. The recording head 13 for ejecting ink onto the sheet P, thereby executing recording on the sheet P is mounted on a lower face of the carriage. An ink cartridge is attached to the carriage.

A platen 28 for defining a platen gap PG between the head face of the recording head 13 and the sheet P is provided below the recording head 13. By alternately repeating an operation for transporting the sheet P in a predetermined pitch between the recording head 13 and the platen 28 in a secondary scanning direction Y which is orthogonal to the primary scanning direction X and an operation for ejecting ink from the recording head 13 onto the sheet P while the recording head 13 is reciprocated in the primary scanning direction X, a desirable recording operation is executed over the entire surface of the sheet P. The platen gap PG is a very important for executing the recording operation with high precision and is properly regulated corresponding to a change in a thickness of the sheet P or the use of a tray mounting an optical disk serving as a target medium.

A sheet ejecting roller 20 which is constituted by a driving roller 20*a* and a follower roller 20*b* is provided in the downstream side of the recording head 13. Moreover, an auxiliary sheet ejecting roller 22 for aiding the ejection of the sheet P is provided on the upstream side of the sheet ejecting roller 20. The auxiliary sheet ejecting roller 22 is constituted by a driving roller 22*a* and a follower roller 22*b*. The sheet P transported by the sheet ejecting roller 20 and the auxiliary sheet ejecting roller 22 is ejected on a stacker (not shown).

The follower roller 20*b* and the follower roller 22*b* are spur rollers having a plurality of teeth on outer peripheries thereof, and are supported by a roller holder. The follower roller 19*b* is disposed in such a manner that a position of an axial core thereof is placed in the downstream side of the driving roller 19*a*. The follower roller 20*b* and the follower roller 22*b* are disposed in such a manner that positions of axial cores thereof are placed in the upstream side of the driving roller 20*a* and the driving roller 22*a*, respectively. By taking such an arrangement, there is brought about a curving state in which the sheet P is curved slightly downward between the sheet transporting roller 19 and the sheet ejecting roller 20 or the auxiliary sheet ejecting roller 22. Consequently, the sheet P positioned opposite to the recording head 13 is pushed against the platen 28 so that a rise in the sheet P is prevented and the recording operation is thus executed normally.

Next, specific description will be given to the edge guide 15 with reference to FIGS. 3 through 7.

In this embodiment, one of the edge guides 15 is a fixed edge guide 15A and the other is a movable edge guide 15B.

Figure 4:
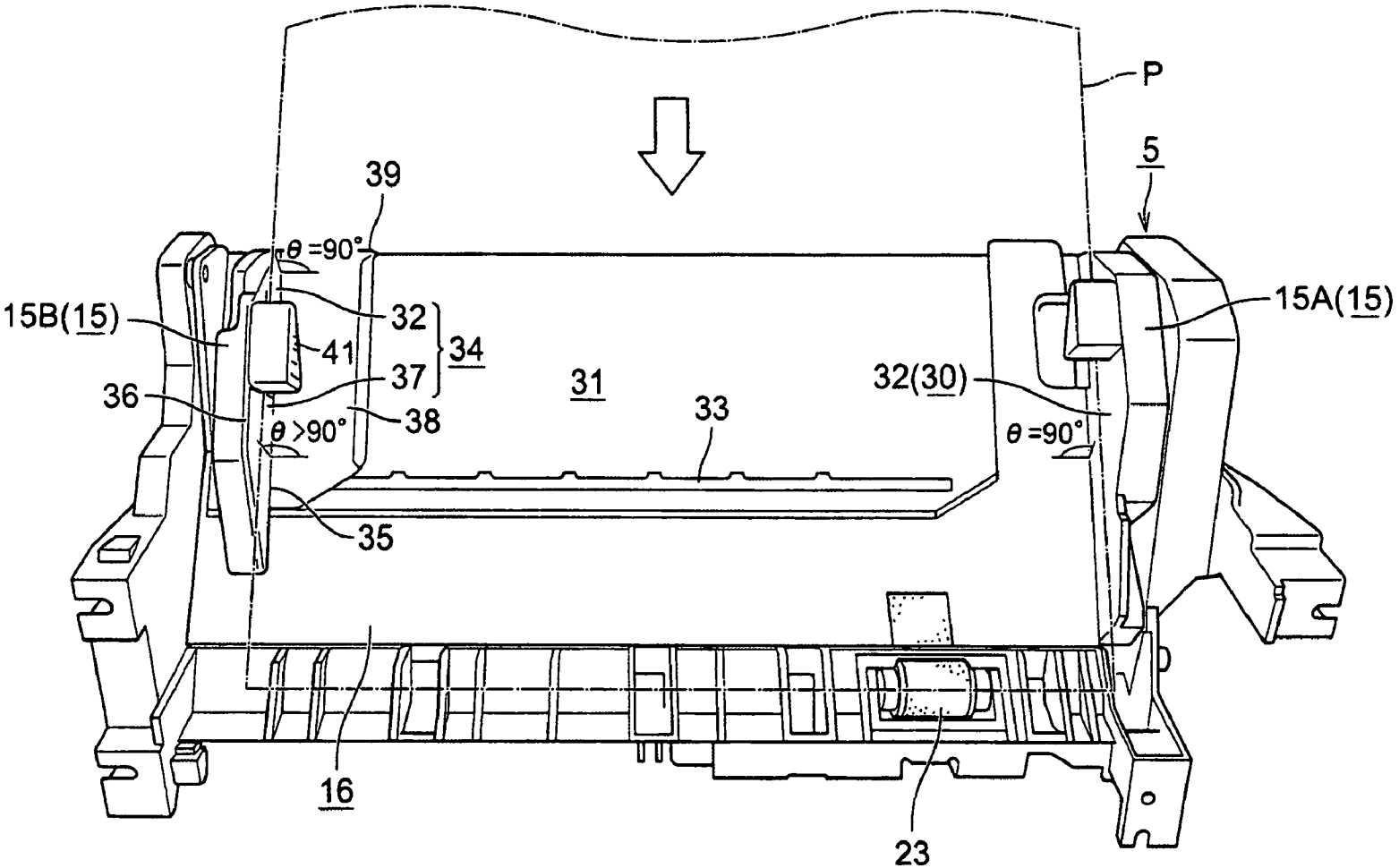
FIG. 4 is a perspective view of the ink jet printer, showing the initial stage of the feeding operation
Figure 6:
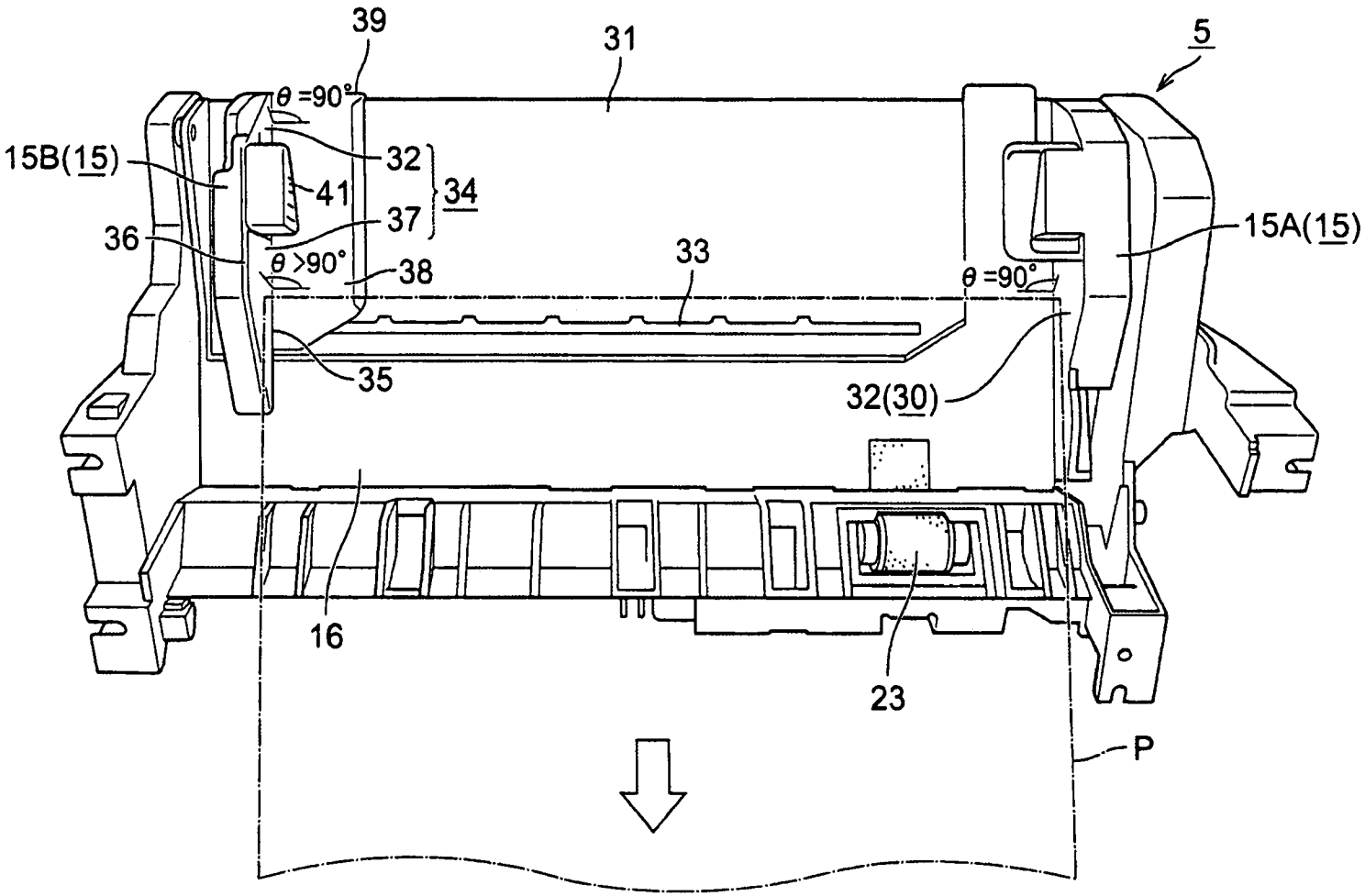
FIG. 6 is a perspective view of the ink jet printer, showing the final stage of the feeding operation.

The fixed edge guide 15A is a guide member fixed to the hopper 16 for supporting one of the side edges of the sheet P (a right side edge of the sheet in FIGS. 4 and 6). A guiding face 30 is adapted to abut on one of the side edges of the sheet P to serve as a reference plane when the sheet P is set to the feeding tray 5. The guiding face 30 is constituted by only a vertical regulating face 32 which is extended from a sheet mounting face 31 perpendicularly. That is, an angle θ defined by the guiding face 30 the sheet mounting face 31 is 90 degrees.

The movable edge guide 15B is a guide member supporting the other side edge of the sheet P (a left side edge of the sheet in FIGS. 4 and 6) and fitted with a guide groove 33 formed on the sheet mounting face 31 of the hopper 16 so as to be movable in a transverse direction of the sheet P. A guiding face 34 is adapted to abut on the other side edge of the sheet P. The guiding face 34 is configured such that an angle defined by an downstream part of the guiding face 34 and the sheet mounting face 31 is made different from that defined by an upstream part of the guiding face 34 and the sheet mounting face 31. More specifically, the upstream part is so formed as to be a vertical regulating face 32 extending perpendicularly from the sheet mounting face 31 (i.e., θ is 90 degrees). The downstream part is so formed as to be an inclined regulating face 37 extending outward from the normal direction of the sheet mounting face 31. That is, a lower part (closer to the sheet mounting face 31) of the inclined regulating face 37 is made flush with the vertical regulating face 32. An upper part (away from the sheet mounting face 31) of the inclined regulating face 37 is retracted outward from the vertical regulating face 32. Thus, an angle θ defined by the inclined regulating face 37 and the sheet mounting face 31 is greater than 90 degrees.

Figure 7:
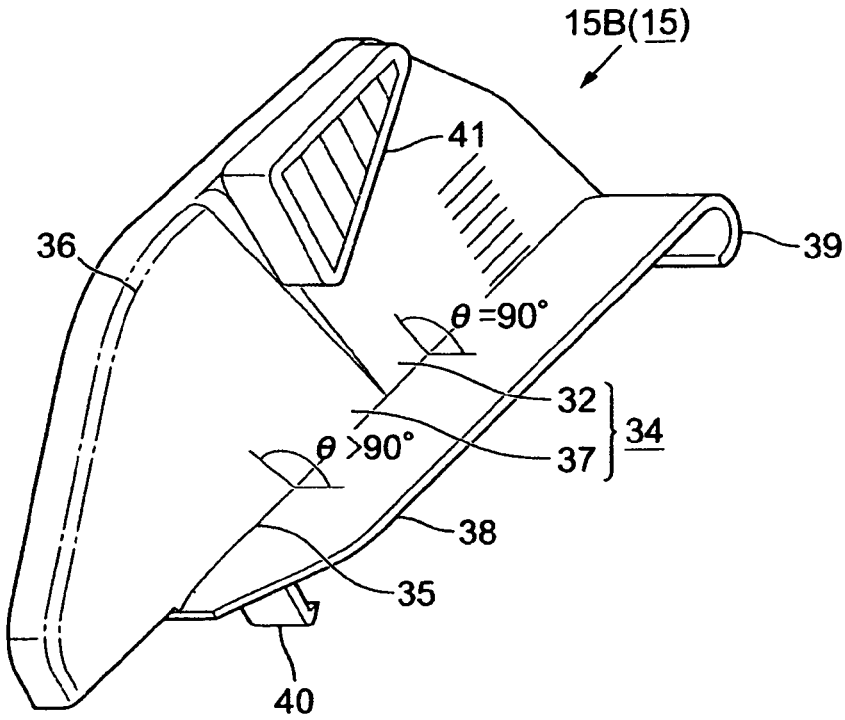
FIG. 7 is an enlarged perspective view of an edge guide in the ink jet printer.

As shown in FIG. 7, the movable edge guide 15B is provided with a slider 38 extended from a lower end of the guiding face 34 inward in a direction parallel to the sheet mounting face 31. An upstream part of the slider 38 is provided with a hook 39 which is attached to be hung on an upstream end of the hopper 16 from above. A downstream part of the slider 38 is provided with a claw 40 to be engaged with the guide groove 33. Moreover, an upper part of the vertical regulating face 32 is provided with a knob 41 to be operated when the movable edge guide 15B is moved in the transverse direction of the sheet P.

Figure 3:
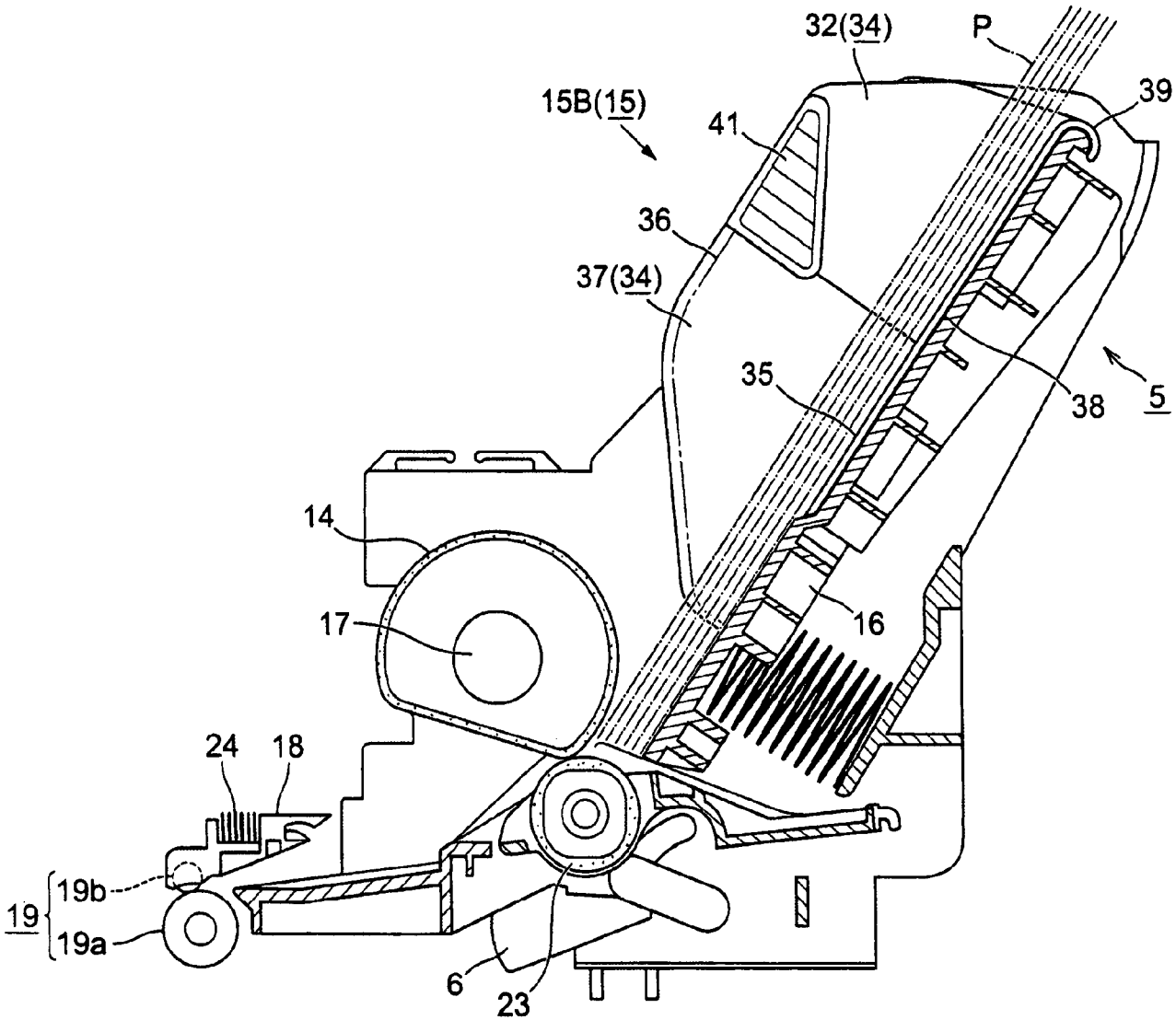
FIG. 3 is a sectional side view of the ink jet printer, showing an initial stage of a feeding operation.

When an instruction for starting a feed is given, as shown in FIGS. 3 and 4, the hopper 16 is started to be lifted and the sheets P stacked on the sheet mounting face 31 are pushed upward and are caused to come in pressure contact with a peripheral face of the sheet feeding roller 14. In a case where a large number of sheets P are stacked on the sheet mounting face 31, a distance between the side edge of the upper sheet P and the inclined regulating face 37 becomes large so that the regulation of the side edge of the sheet P is slightly relieved. On the other hand, since a lifted stroke of the hopper 16 is small, the amount of the movement of the sheet P is very small. In the initial stage of the feeding operation, moreover, the trailing end portions (upstream end portions) of the side edges of the sheet P are maintained to be held by the vertical regulating faces 32 so that the regulation of the side edges of the sheet P is strict. Therefore, the movement of the sheet P and the skew of the sheet P with the movement are not caused.

In a case where the number of the sheets P stacked on the sheet mounting face 31 is small, the distance between the side edge of the upper sheet P and the inclined regulating face 37 becomes small and the regulation of the side edge of the sheet P is strict. On the other hand, since the lifted stroke of the hopper 16 is large, there is a probability that the sheet P might be moved greatly. However, the side edge of the sheet P is reliably held by the vertical regulating face 32 and the inclined regulating face 37 capable of executing the strict regulation. Therefore, the movement of the sheet P and the skew of the sheet P with the movement are not caused.

Figure 5:
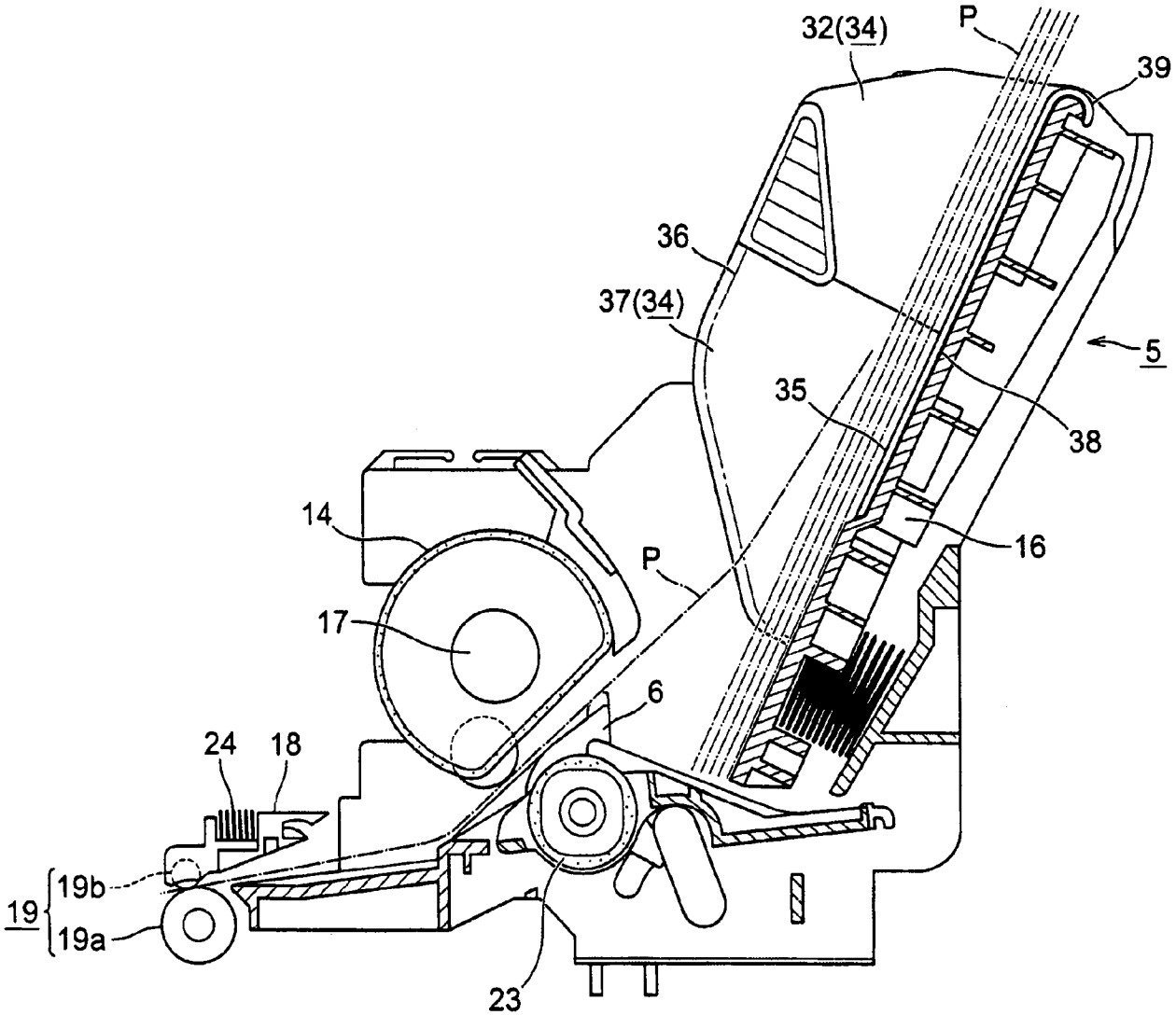
FIG. 5 is a sectional side view of the ink jet printer, showing a final stage of the feeding operation.

When the feeding operation performed by the sheet feeding roller 14 and the hopper 16 progresses, as shown in FIGS. 5 and 6, the leading end of the uppermost sheet P reaches the sheet transporting roller 19 and the trailing end portion of the side edge of the sheet P separates from the vertical regulating face 32 and reaches the inclined regulating face 37. Accordingly, a frictional resistance from the guiding face 34 acting on the side edge of the sheet P is reduced so that the sheet P is smoothly transported by the sheet transporting roller 19.

In this state, the hopper 16 is moved downward and reaches a lower limit position as shown in FIG. 5, and the distance between the side edge of the sheet P which is being fed and the inclined regulating face 37 is increased so that the regulation of the side edge of the sheet P is slightly relieved. However, since two parts of the sheet P is nipped by the sheet transporting roller 19, the sheet feeding roller 14 and retard roller 23, the skew of the sheet P is generated with difficulty. Consequently, the relief of the regulation does not matter. The succeeding sheets P separated by the retard roller 23 are pushed upward by the returning lever 6, are guided by the inclined regulating face 37, are aligned and are returned to the original position on the feeding tray 5.

Next, a second embodiment of the invention will be described. Components similar to those in the first embodiment will be designated by the same reference numerals, and repetitive explanations for those will be omitted.

Figure 8:
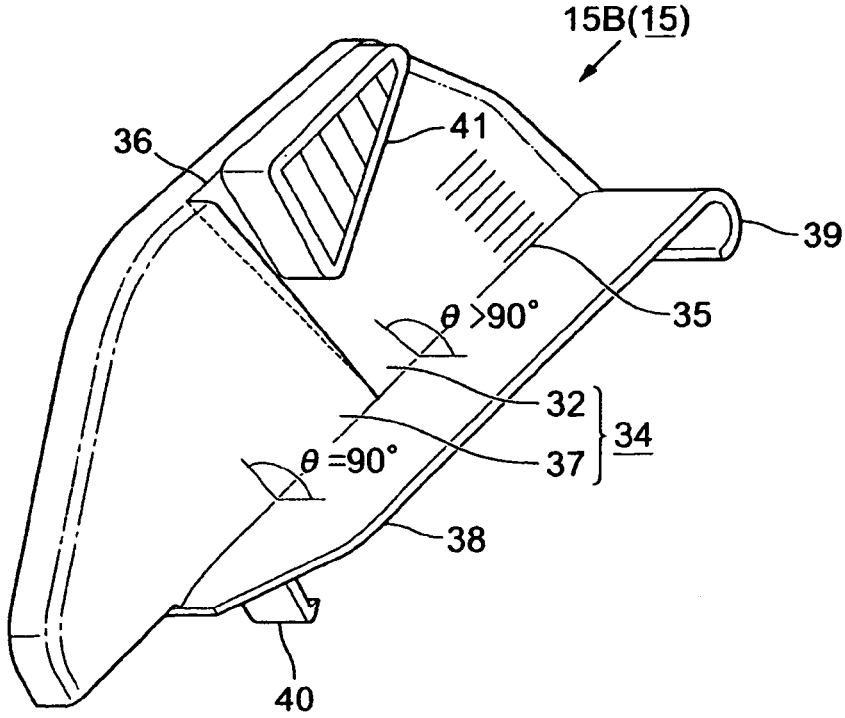
FIG. 8 is a perspective view of an edge guide according to a second embodiment of the invention.

As shown in FIG. 8, in this embodiment, the arrangement of the vertical regulating face 32 and the inclined regulating face 37 is reversed. That is, the guiding face 34 includes the vertical regulating face 32 located at a downstream part thereof and the inclined regulating face 37 located at an upstream part thereof.

With this configuration, the strict regulation of the side edge of the sheet P is maintained from the initial stage of the feeding operation to the final stage thereof. Therefore, the skew of the sheet P is not generated.

Moreover, the sheet P on the feeding tray 5 lifted by the hopper 16 and the sheet P returned onto the feeding tray 5 by the returning lever 6 can be returned to the original position on the feeding tray 5 without the trailing end portion of the side edge of the sheet P caught on the movable edge guide 15B by the presence of the inclined regulating face 37.

Next, a third embodiment of the invention will be described. Components similar to those in the first embodiment will be designated by the same reference numerals, and repetitive explanations for those will be omitted.

Figure 9:
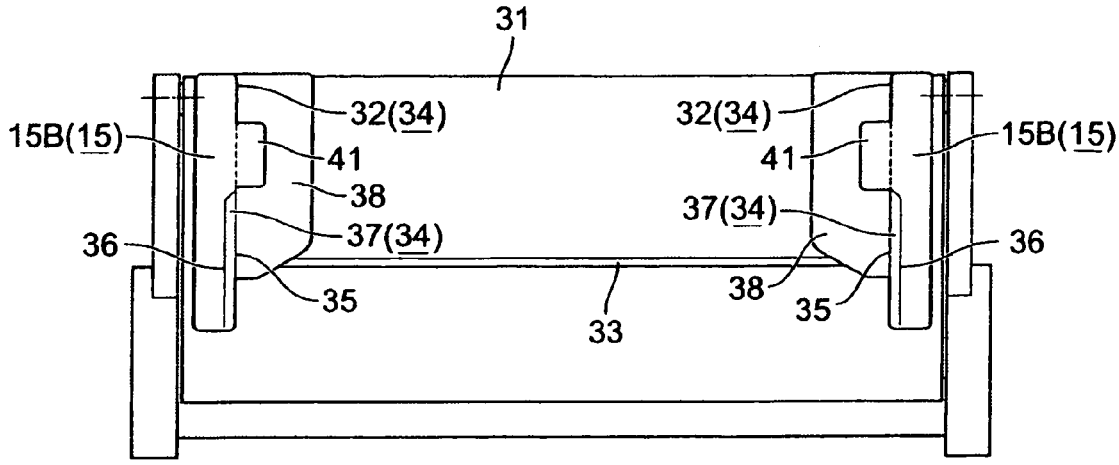
FIG. 9 is a front view of edge guides according to a third embodiment of the invention.
Figure 10:
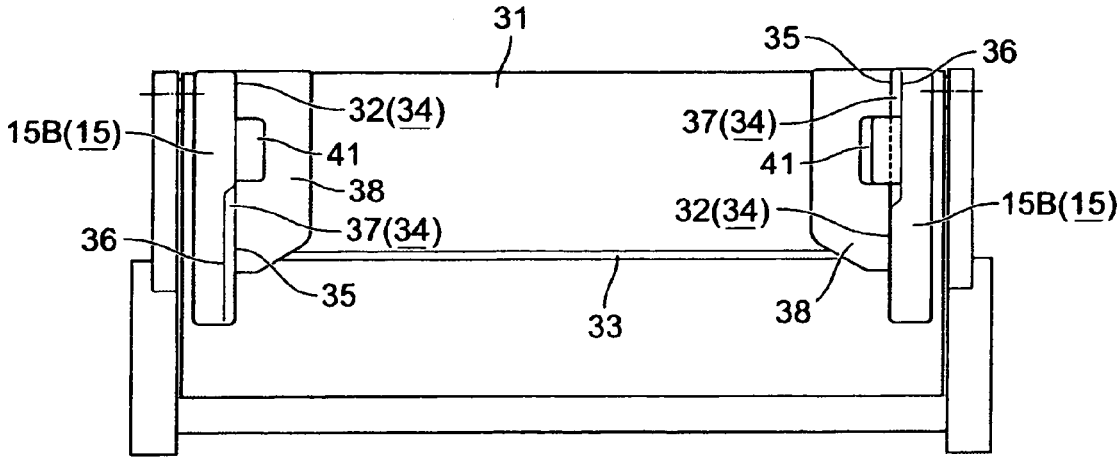
FIG. 10 is a front view showing a modified example of edge guides of FIG. 9.

As shown in FIG. 9, in this embodiment, the inclined regulating face 37 is provided on each of the edge guides 15. The inclined regulating faces 37 are opposed to each other at the respective downward parts of the edge guides 15. As shown in FIG. 10, in one of the edge guides 15, the inclined regulating face 37 may be located at the upstream part thereof as in the second embodiment.

With this configuration, frictional resistances applied from both of the guiding faces 34 in the edge guides 15 can be reduced together and the sheet P can be fed more smoothly. In the case of FIG. 9, the frictional resistance acting on the side edge of the sheet P is balanced. Consequently, the skew of the sheet P which is being fed is generated with more difficulty. In the case of FIG. 10, respective advantages are promoted and respective drawbacks are complemented.

Next, a fourth embodiment of the invention will be described. Components similar to those in the first embodiment will be designated by the same reference numerals, and repetitive explanations for those will be omitted.

Figure 11:
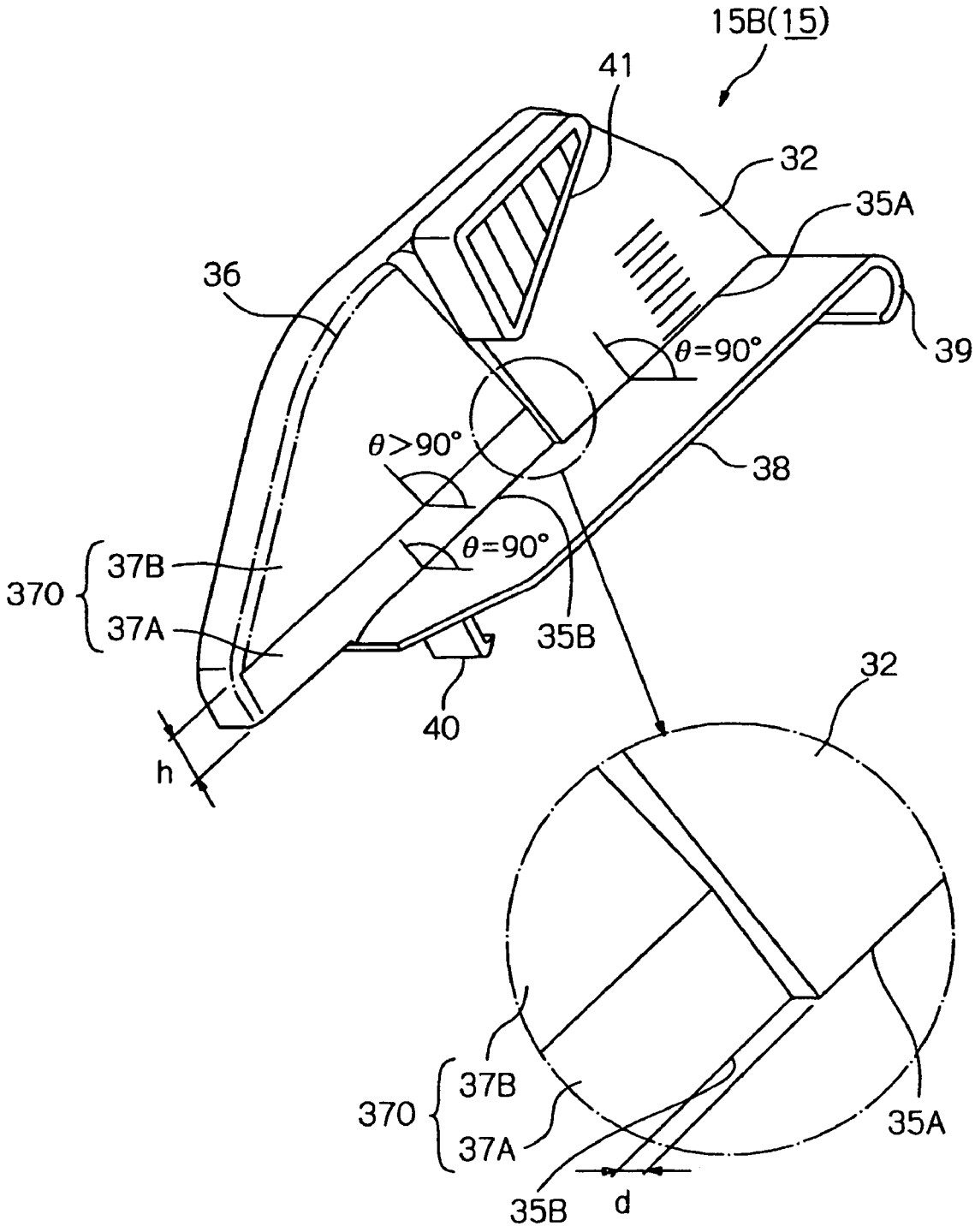
FIG. 11 is a perspective view of an edge guide according to a fourth embodiment of the invention.

As shown in FIG. 11, in this embodiment, the downstream part of the movable edge guide 15B is so formed as to be an inclined regulating face 370 including a lower vertical face 37A and an upper inclined face 37B. The lower vertical face 37A having a height "h" is retracted from the vertical regulating face 32 by a dimension "d". That is, the lower end 35A of the vertical regulating face 32 is not flush with the lower end 35B of the inclined regulating face 370. The vertical face 37A is extended perpendicularly from the sheet mounting face 31. That is, an angle defined by the vertical face 37A and the sheet mounting face 31 is 90 degrees. The inclined face 37B extends outward from the normal direction of the sheet mounting face 31. That is, an angle θ defined by the inclined face 37B and the sheet mounting face 31 is greater than 90 degrees.

For example, the dimension "d" is 0.3 mm, the angle θ defined by the inclined face 37B and the sheet mounting face 31 is 93.5 degrees, and the height "h" of the vertical face 37A is 4.9 mm.

Figure 12:
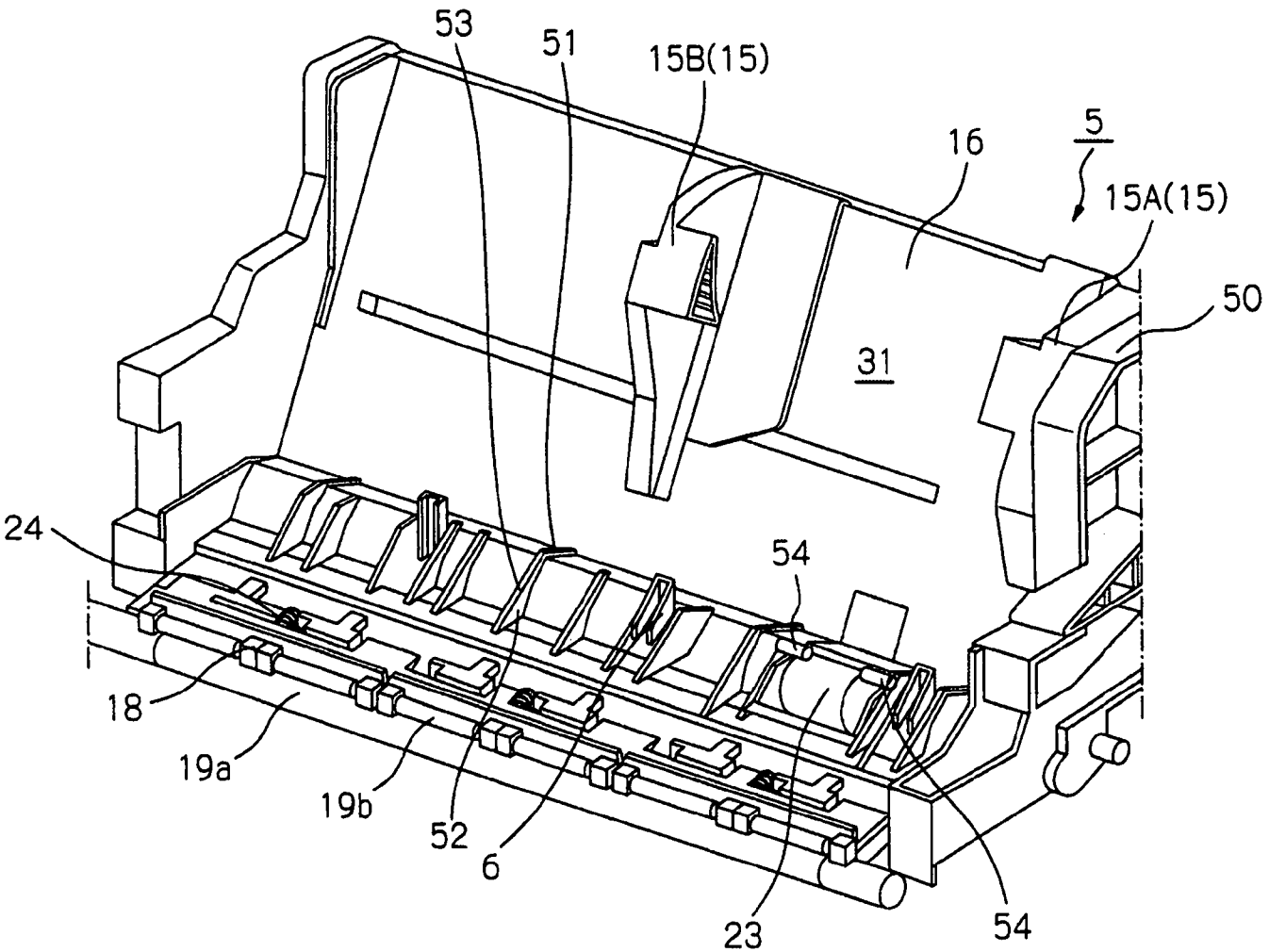
FIG. 12 is a perspective view showing a feeding tray provided with the edge guide of FIG. 11.

As shown in FIG. 12, the feeding tray 5 provided with this movable edge guide 15B has a base body constituted by a frame 50 formed with a plurality of ribs 52 arrayed in the transverse direction of the sheet P with a fixed pitch. A top face of each of the ribs 52 includes a supporting face 51 positioned opposite to a lower end of the hopper 16 and serving to support a leading end of the sheet P set in an inclination posture and a guiding face 53 positioned opposite to the feeding roller 14 and serving to guide the leading end of the sheet P toward a downstream side.

Figure 14:
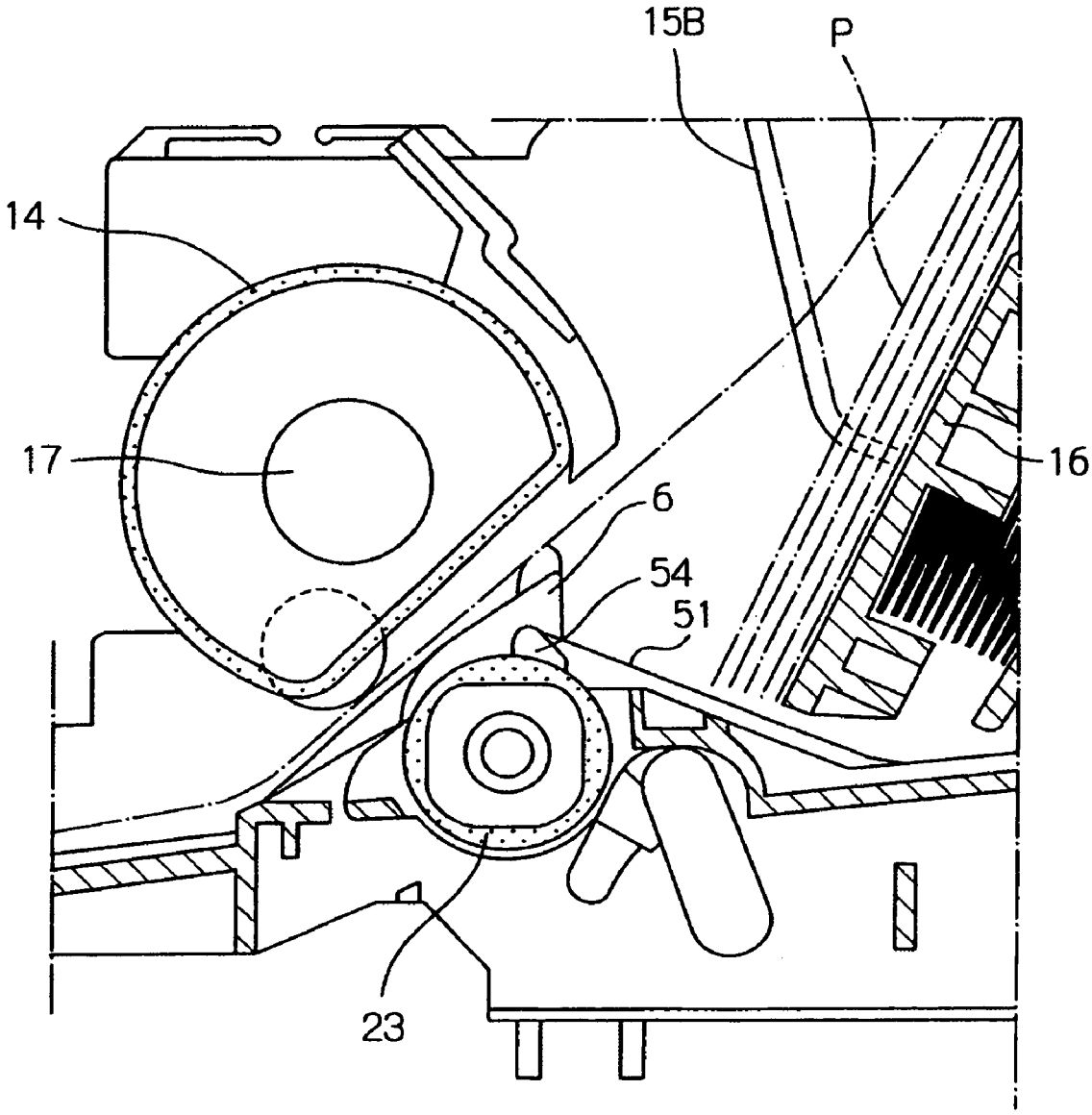
FIG. 14 is an enlarged sectional side view showing a lower part of the feeding tray of FIG. 12.

At both sides of the retard roller 23, regulators 54 are provided so as to oppose positions at which the supporting face 61 and the guiding face 53 are connected. The regulators 54 is projected toward the sheet feeding path as shown in FIG. 14, thereby limiting the number of the sheets P entering a nipping point of the sheet feeding roller 14 and the retard roller 23.

The regulators 54 are located at positions which are shifted from the widthwise center of the sheet P to be fed. In this situation, the leading end of the sheet P abuts on the regulators 54 with a rise in the hopper 16 so that a skew tendency (a tendency direction shown in an arrow M of FIG. 13) is generated on the sheet P. Consequently, the side edge on the movable edge guide 15B side of the sheet P generates a tendency which strongly comes in contact with the movable edge guide 15B.

Figure 15:
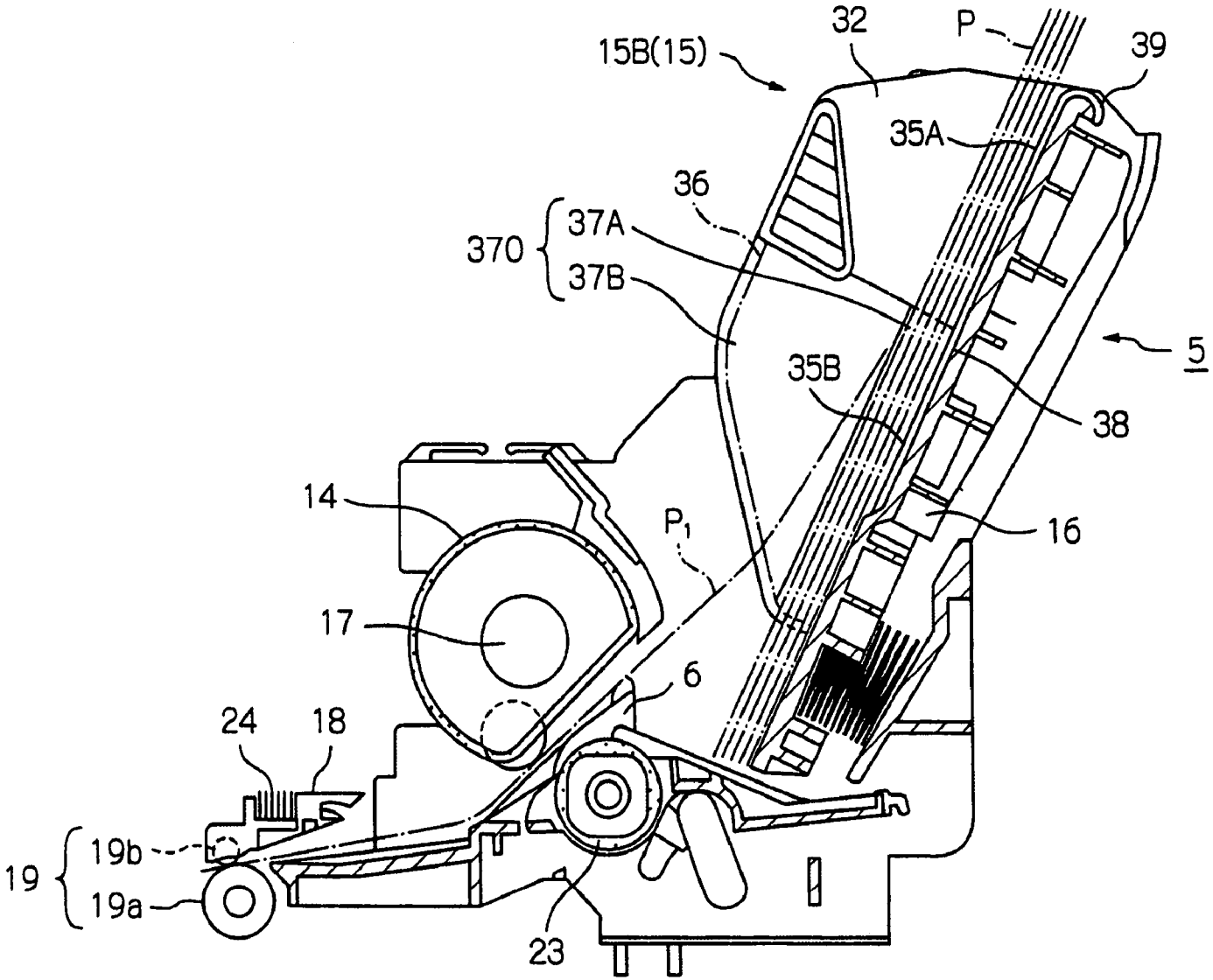
FIG. 15 is a sectional side view showing the feeding tray of FIG. 12.

As shown in FIG. 15, in the initial stage of the feeding operation of the sheet P, the vertical regulating face 32 abuts on a side edge in a trailing end side of the sheet P, so that the strict regulation of the side edge of the sheet P is maintained and the generation of the skew of the sheet P is prevented. When the sheet P which is fed is nipped by the sheet transporting roller 19, a skew removing operation is executed. More specifically, in a state in which the trailing end of the sheet P is nipped between the sheet feeding roller 14 and the retard roller 23, the sheet transporting roller 19 is once rotated reversely to eject the leading end of the sheet P to the upstream side of the sheet transporting roller 19 and to nip the sheet P by the sheet transporting roller 19 again.

FIG. 15 shows a state in which a sheet P1 is thus subjected to the skew removing operation and the recording operation can be executed (a state in which the operation beginning position is found). As shown, the side edge of the trailing end portion of the sheet P in this state is released from the regulation state brought by the vertical regulating face 32 and is maintained to be opposed to the inclined regulating face 370.

Figure 13:
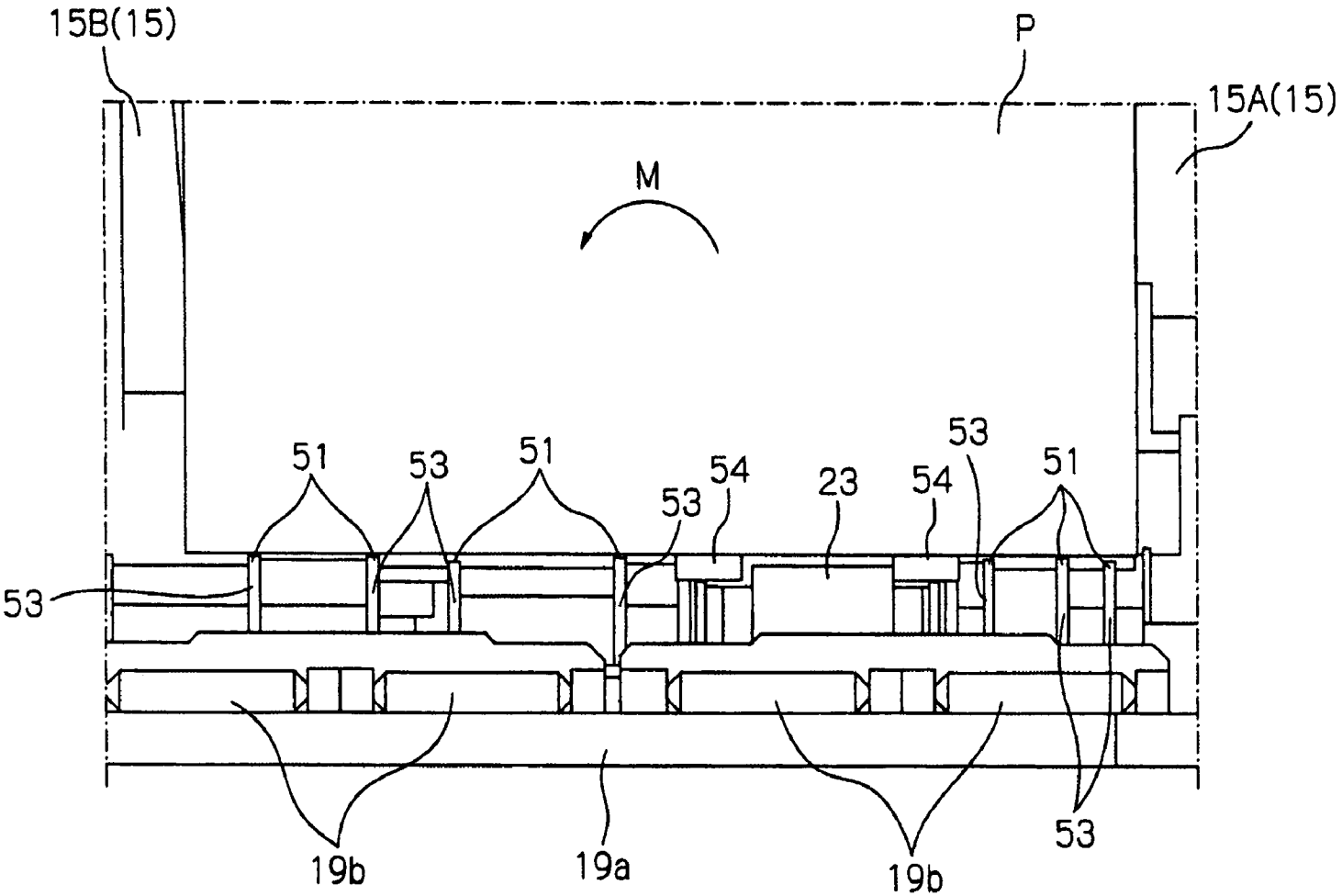
FIG. 13 is a front view of the feeding tray of FIG. 12.

The skew tendency is generated over the sheet P1 as shown in FIG. 13 when the feeding operation is performed. In some cases, the skew tendency remains slightly even though a skew correction is carried out by the screw removing operation. In such cases, the side edge of the trailing end portion of the sheet P1 generates such a tendency as to strongly come in contact with the guiding face of the movable edge guide 15B. However, the side edge of the trailing end portion of the sheet P1 in the beginning of the recording operation is maintained to be opposed to the inclined regulating face 370 as described above. Since the inclined regulating face 370 is constituted to include the vertical face 37A retracted outward from the first regulating face 32 and the inclined face 37B extending further outward, even if the skew tendency remains on the sheet P1, the side edge on the trailing end portion of the sheet P1 can be prevented from strongly coming in contact with the movable edge guide 15B.

Accordingly, it is possible to reduce a frictional resistance between the sheet P1 and the movable edge guide 15B, that is, a back tension, thereby executing a smooth transporting operation. Consequently, it is possible to prevent a deterioration in the quality of the recording operation.

Also in the case in which the side edge of the trailing end portion of the sheet at the beginning of the recording operation is not positioned opposite to the inclined regulating face 370 as in the sheet P1 in FIG. 15, the frictional resistance between the side edge of the sheet P and the movable edge guide 15B can be reduced and the smooth feeding of the sheet P can be executed without the influence of a difference in the quality and properties of the sheet P because of the provision of the inclined regulating face 370. Moreover, the sheet P lifted by the hopper 16 and the sheet P returned by the returning lever 6 can be guided to slide over the inclined face 37B, and can be aligned and can be returned to the original position.

The edge guide 15 is not limited to the edge guide provided for the feeding tray 5 but can be applied to various edge guides having different structures and objects, for example, the edge guide constituted by the two movable edge guides 15B provided for the feeding cassette and moving to approach and separate from each other as shown in FIGS. 9 and 10 or the edge guide for guiding the side edge of the sheet reeled from a rolled sheet holder.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. A feeder, adapted to feed a medium to an apparatus body in a first direction, the feeder comprising:

a first face, adapted to support the medium from below;

a first edge guide, disposed on the first face and having a first guiding face adapted to support a first side edge of the medium;

a second edge guide, disposed on the first face and having a second guiding face adapted to support a second side edge of the medium, wherein:

the first guiding face includes:

a second face extending such that a first angle is formed by the first face and the second face; and a third face located in a downstream side of the second face relative to the first direction, and extending such that a second angle which is different from the first angle is formed by the first face and the third face; and one of the first angle and the second angle is 90 degrees and the other one is greater than 90 degrees, wherein upper ends of the second face and the third face are flush with each other.

* * * * *